US008951134B2

(12) United States Patent
Hoeschler et al.

(10) Patent No.: US 8,951,134 B2
(45) Date of Patent: Feb. 10, 2015

(54) ARTIFICIAL SPORT LOG

(71) Applicants: Judith L. Hoeschler, La Crosse, WI (US); Jay F. Hoeschler, La Crosse, WI (US); Abigael A. Hoeschler, La Crosse, WI (US)

(72) Inventors: Judith L. Hoeschler, La Crosse, WI (US); Jay F. Hoeschler, La Crosse, WI (US); Abigael A. Hoeschler, La Crosse, WI (US)

( * ) Notice: Subject to any disclaimer, the term of this patent is extended or adjusted under 35 U.S.C. 154(b) by 38 days.

(21) Appl. No.: 14/012,193

(22) Filed: Aug. 28, 2013

(65) Prior Publication Data

US 2013/0344972 A1 Dec. 26, 2013

Related U.S. Application Data

(63) Continuation-in-part of application No. 13/300,001, filed on Nov. 18, 2011, now Pat. No. 8,651,972.

(51) Int. Cl.

| | |
|---|---|
| ***A63B 4/00*** | (2006.01) |
| ***A63B 26/00*** | (2006.01) |
| ***A63B 69/00*** | (2006.01) |
| ***A63B 22/16*** | (2006.01) |
| *A63B 23/10* | (2006.01) |
| *A63B 67/00* | (2006.01) |
| *A63B 71/02* | (2006.01) |

(52) U.S. Cl.

CPC ..... *A63B 26/00* (2013.01); *A63B 26/003* (2013.01); *A63B 69/0028* (2013.01); *A63B 22/16* (2013.01); *A63B 67/007* (2013.01); *A63B 2071/026* (2013.01); *A63B 2208/0204* (2013.01); *A63B 2210/50* (2013.01); *A63B 2225/605* (2013.01)

USPC ..... 472/127; 472/129; 482/79

(58) Field of Classification Search

USPC ..... 472/127, 129; 446/153, 155, 160; 434/247, 250, 253; 482/79, 80

See application file for complete search history.

(56) References Cited

U.S. PATENT DOCUMENTS

| | | | | |
|---|---|---|---|---|
| 2,931,648 | A | 4/1960 | Davies | |
| 3,329,425 | A | 7/1967 | Gieseler | |
| 3,887,179 | A * | 6/1975 | Klepper et al. | 472/127 |
| 3,953,024 | A | 4/1976 | Brubacher | |
| 4,016,826 | A * | 4/1977 | Sanders | 114/283 |
| 4,281,830 | A | 8/1981 | Rehbein | |
| 5,009,413 | A | 4/1991 | Allen | |
| 5,334,100 | A * | 8/1994 | Bailey | 472/127 |
| 5,663,210 | A | 9/1997 | Sugimoto et al. | |
| 6,220,599 | B1 | 4/2001 | Eisch | |
| 6,494,816 | B1 * | 12/2002 | Corrado | 482/79 |
| 6,811,539 | B1 * | 11/2004 | Nguyen | 601/31 |
| 6,845,952 | B2 | 1/2005 | Abel et al. | |
| 7,998,031 | B2 | 8/2011 | Dumke et al. | |

* cited by examiner

*Primary Examiner* — Kien Nguyen

(74) *Attorney, Agent, or Firm* — Nikolai & Mersereau, P.A.; C. G. Mersereau

(57) ABSTRACT

A lightweight, portable artificial sport log for logrolling, having physical properties that mimic a selected natural log, has a hollow cylindrical shell of a suitable high density polymeric material and an internal baffle support shape of a rigid polymeric material fixed to the internal surface of the cylindrical shell. One or more sealable fill/drain ports allow addition and draining of water from the artificial log. Auxiliary training devices to control log rotation are disclosed, as is an inflatable embodiment.

20 Claims, 10 Drawing Sheets

ARTIFICIAL SPORT LOG

CROSS-REFERENCED TO RELATED APPLICATIONS

This application is a continuation-in-part of application Ser. No. 13/300,001, filed Nov. 18, 2011, entitled "ARTIFICIAL SPORT LOG".

STATEMENT REGARDING FEDERALLY SPONSORED RESEARCH OR DEVELOPMENT

Not applicable

BACKGROUND OF THE INVENTION

I. Field of the Invention

The present invention relates generally to sport log devices such as the type used in logrolling competitions or for fun and, more particularly, to a lightweight, easily portable synthetic sport log that can be manufactured to closely mimic the behavioral physical characteristics of a natural wooden log such as one of the type used for logrolling when the synthetic log is filled with water and floated in water. This includes buoyancy and mass moment of inertia.

II. Related Art

Logrolling has long been well known as a recreational or competitive water sport. The logs used in this sport, including practice logs, are typically about 6-12 feet (1.85-3.7 m) long and 12-18 inches (38.1-45.7 cm) in diameter and are made of a wood, typically western red cedar, weighing upwards of 340 pounds (154 kg) for a 12" (38.1 cm) log and up to about 800 pounds (363 kg) for an 18" (45.7 cm) log. The disadvantages associated with the use of natural logs, including size, weight and interactions with water, and export/import restrictions have made repeated transporting and deployment of natural logs difficult. This has led to attempts to make artificial logs that do not pick up fungi, etc. and are easier to transport and deploy. However, these artificial logs have met with only a minor degree of success to date due to deficiencies in the behavioral physical characteristics of the artificial logs when compared to their natural counterparts.

One design of an artificial log is found in U.S. Pat. No. 4,281,830, which discloses a manufactured log that includes a pair of conjoined, substantially identical, opposed hollow longitudinal cylindrical half sections designed to be filled with water and that may contain circumferential baffles and/or inwardly directed longitudinal flanges attached to the half sections designed to control a log behavior. While that design has met with some success, such a design has still fallen short of displaying the characteristics of a comparable natural log.

SUMMARY OF THE INVENTION

By means of the present invention, there is provided a lightweight, easily portable artificial sport log suitable for logrolling or other endeavors using a buoyant floating log when it is filled with water. The log has a design that comes very close to mimicking the physical characteristics of a corresponding selected natural log in the water, vet is lightweight and quite portable when empty. The artificial sport log of the invention is designed to be transported and stored empty and filled with water for use. The log design of the invention includes an outer cylindrical shell, preferably of a relatively rigid foamed polymeric material, having end caps and a fixed internal baffle system of a lightweight rigid polymeric foam material which may be in the shape of a symmetrical cross or other shape which, when fixed to the outer shell, defines a plurality of at least three symmetrical similar separate compartments for containing water when the log is in use. The baffle affords additional strength to the shell and if fewer than three are used the distance between supports becomes too great.

As used herein, the term "polymeric material" is meant to be construed in a broad sense so as to include any composition suitable for the parts of the log. Foamed materials are preferred as they are relatively lightweight. The thickness and density of the baffle in relation to the diameter of the shell determines the relative mass moment of inertia and buoyancy of the artificial log and can be configured to closely match a selected variety of natural log such as western red cedar.

Logs in accordance with the present invention may be of any desired size and the internal baffle configuration is configured so that the water compartments are outside the baffle and is sized to provide the desired buoyancy and mass moment of inertia to mimic a natural log of interest. For use in logrolling the logs of the invention are typically about 12 feet long and 12-18 inches in diameter and weighing from about 50 pounds to about 100 pounds empty. Openings are provided in the shell end caps or other locations on the logs for filling the artificial log with water for use and draining the log for transport and storage. The fill/discharge openings are provided with removable caps or plugs that may be tethered or removable.

The outer surface of the log may be rough or smooth and a layer of carpeting or synthetic traction material may be added to the central area to increase traction if desired. For example, the area on the log used by log rollers may be roughened to provide the desired amount of traction on the log surface. The roughened surface itself also can provide the necessary traction.

BRIEF DESCRIPTION OF THE DRAWINGS

In the drawings wherein like numerals depict like parts throughout the same.

DETAILED DESCRIPTION

The following description details one or more exemplary embodiments illustrating the present invention. It will be appreciated that the detailed descriptions are intended by way of example only and are not intended to limit the scope of the invention in any respect. It will be further understood that the embodiments of the invention can be modified by those skilled in the art while remaining in keeping with the inventive concepts.

Figure 1:
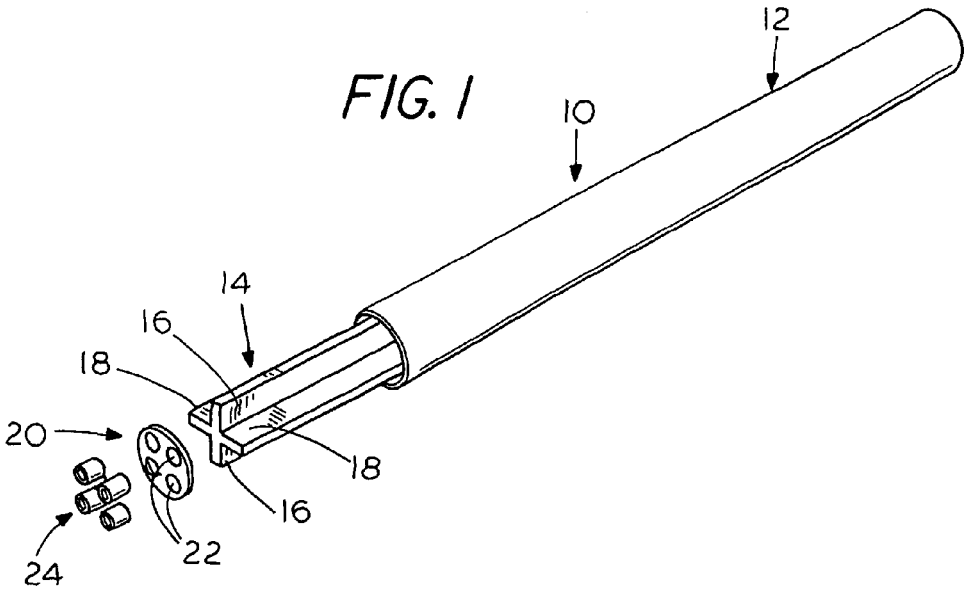
FIG. 1 is an exploded perspective view of an embodiment of a log in accordance with the invention.

FIG. 1 is an exploded perspective view of an embodiment of a log 10 having an outer shell 12. A longitudinal internal baffle 14, shown partially exposed, is in the shape of a cross having vertical arms or members 16 (as shown in the drawing) and horizontal arms or members 18. See also FIG. 2. An end cap is shown at 20 with fill/discharge openings 22 and a set of removable closure caps for the openings at 24. An assembled log is shown in FIG. 3 with the closure caps removed and fill/discharge openings 22 exposed. An optional joint is shown at 26 for assembling the shell from two sections 28 and 30.

The shell may be made from any suitable polymeric material which, with the internal baffle, enables one stand on the log and manipulate the log. Preferred materials include a polyethylene closed cell foamed composition, for example. A shell for logrolling is typically about 12 feet long and 12-18 inches in diameter and about 0.5 inches thick, depending on the material used. The internal baffle provides additional strength and rigidity of the log and is of a very lightweight rigid foam material which may be, for example, a lightweight polyurethane foam having a density of about 2 lbs. per $ft^3$. These materials give the log its buoyancy and the thickness of the arms or cross members 16 and 18 determines the volume of foam relative to water in a filled log and, thus, the weight of the log relative to water when the remainder of the log is filled with water. The baffle cross members are fixed to the internal surface of the log shell and define four separated internal longitudinal volumes. While other numbers of baffle arms can be used (generally three or more), a cross shape with four members has been found to work very well.

Figure 2:
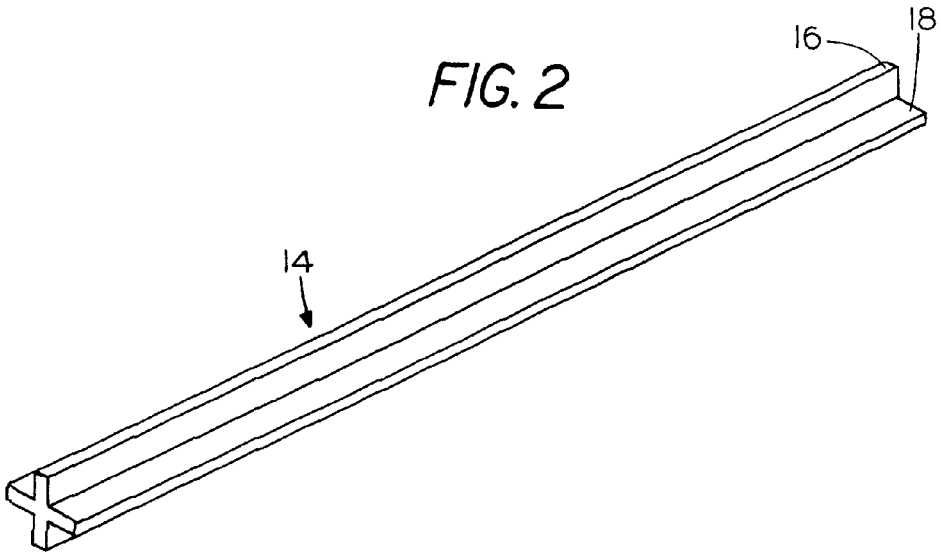
FIG. 2 is a perspective view of the internal baffle of FIG. 1.
Figure 3:
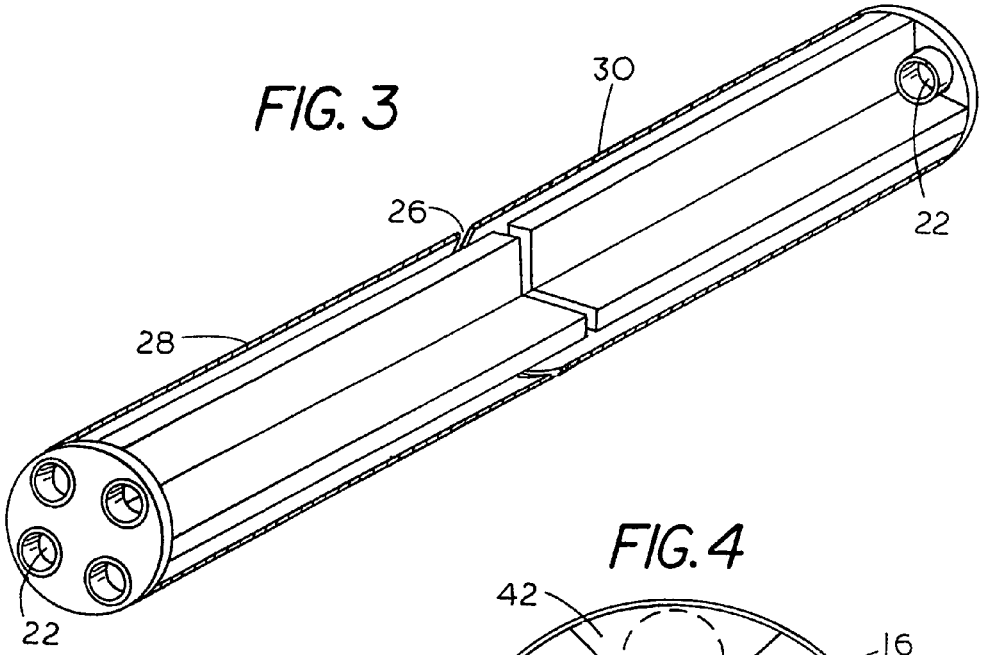
FIG. 3 is a perspective view of an assembled log having two conjoined sections with parts cut away to show fill/drain openings.
Figure 4:
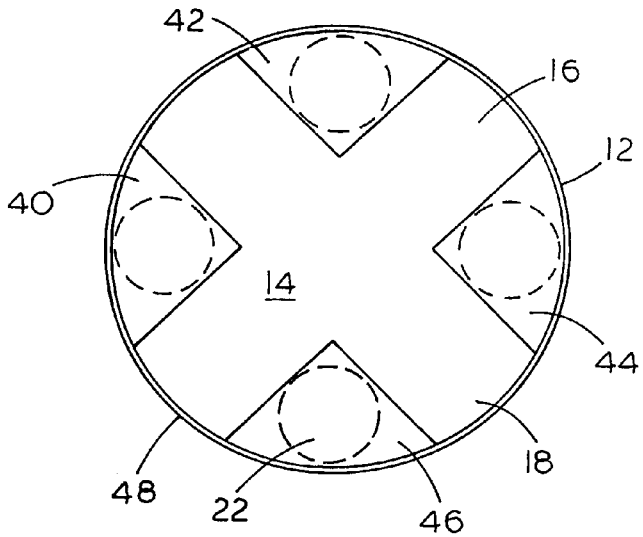
FIG. 4 is an end view of an embodiment of an artificial log in accordance with FIGS. 1-3 shown with the end cap removed.

FIG. 4 is an end view of an artificial log as in FIGS. 1-3 rotated 45° with the end cap removed and showing the relative location of fill/drain ports 22 at a far end of the structure. The drawing defines four outer chambers for containing water at 40, 42, 44 and 46. They are symmetrically located and the configuration of the rigid foam baffle 14 causes the fill water to be contained toward the outside of the structure. The foamed baffle 14 is fixed to the inside surface of the shell 12 in four locations, thereby dividing the internal volume of the shell 12 into four separate symmetrical compartments. Locating the fill water toward the outside of the shell has been found to be quite beneficial with regard to the rotational operation of the log in water.

Figure 5:
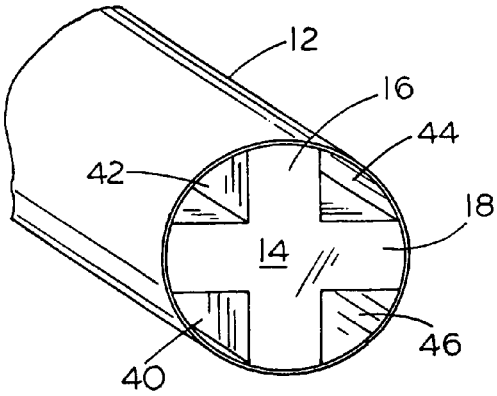
FIG. 5 is a fragmentary perspective view of the embodiment of FIGS. 1-4.
Figure 6:
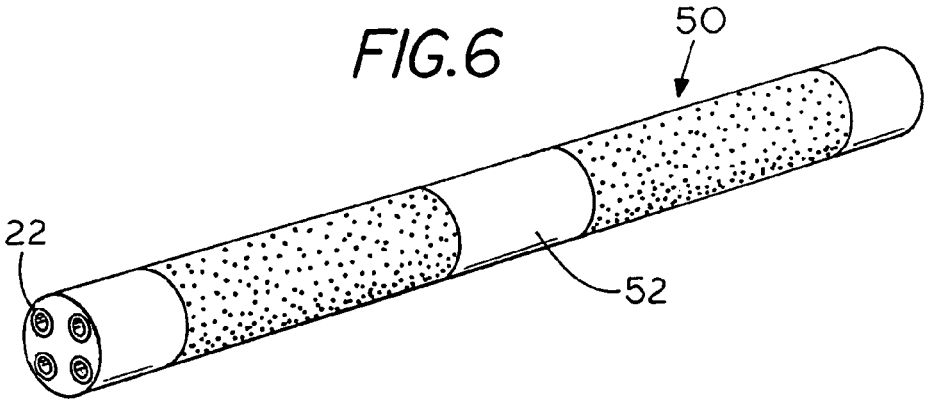
FIG. 6 is a perspective view of a log embodiment in accordance with the invention.
Figure 7:
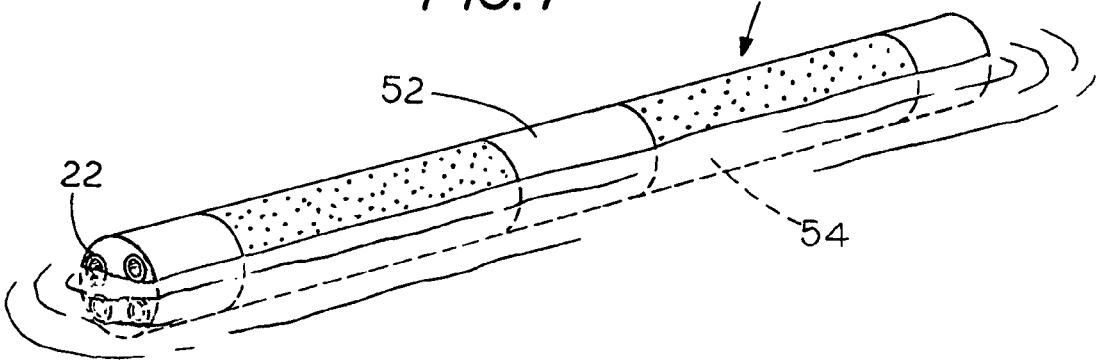
FIG. 7 is a perspective view of the log of FIG. 6 shown filled and floating in water.

FIG. 5 is a fragmentary perspective view of the shell and baffle arrangement as shown in FIG. 4, FIG. 6 is an embodiment of an artificial log 50 showing a central section of the log which may contain. carpet or other material 52 to aid in the stability or traction of the footing of one standing on the log for logrolling. FIG. 7 shows the log of FIG. 6 with the compartments filled with water and floating in water 54.

The relative thickness of the baffle cross members can be sized so that the buoyancy of the filled artificial log equals that of a natural log of a desired wood. If it be assumed that both logs are totally submerged in fresh water, a 16" diameter (40.64 cm)×12' (3.66 m) western red cedar log having a density $\rho$=25 lbs/$ft^3$ has a net buoyancy of ~435 lbs. An equivalent 16"×12' artificial log in accordance with the invention using a foam baffle having a density of 2 lbs/$ft^3$ requires an internal baffle just fitting inside the log having a volume of 7.2 $ft^3$. This yields a buoyancy of 7.2 (62.4−2)=434.9 lbs or ~435 lbs. This assumes that the four compartments defined by the baffle are filled with water and so afford no additional buoyancy. Other sizes of logs can be produced to equal a corresponding natural log of comparable size.

While western red cedar is a popular natural log for use in log rolling, the artificial log of the invention can be manufactured to mimic the characteristics of other woods, if desired.

In addition to duplicating the buoyancy of a natural log, artificial logs fabricated in accordance with the present invention have been found also to possess a mass moment of inertia that mimics that of a comparable natural log so that the artificial log not only has comparable buoyancy but also has comparable rotational characteristics in water.

As previously indicated, the lightweight, rigid foam baffle utilized in the structure of the artificial log of the present invention is not only instrumental in determining the buoyancy and mass moment of inertia of the artificial log, it serves to provide structural support inside the shell of the log which enables the outer shell of the log to be of a lesser thickness. Thus, the closed cell at least partially foamed outer shell combines with the rigid foamed inner baffle to provide a lightweight but very strong log structure in which inner support members are symmetrically placed and support is afforded as the log rotates. It should further be noted that while the internal baffle structure shown in the detailed description is in the shape of a cross containing four arms, other shapes which can attach to the inner surface of the log shell and can divide the volume into a plurality of succinct compartments between the baffle and the shell could also be used successfully. Accordingly, it is anticipated that any symmetrical internal baffle shape having three or more arms could be used. Of course, in order to successfully divide the volume into succinct and separate compartments, the baffle must run the entire length of the shell and be fixed to the shell.

As shown in FIG. 3, it is anticipated that the artificial log of the present invention could be fabricated in two or more sections which could thereafter be joined to form the entire length of the log and a log of any desired dimensions of diameter and length. A distinct advantage of the log of the present invention lies in the fact that when the log is empty, it is very lightweight and easily transported from place to place, unlike heavy natural logs. Thus, a log 15 inches in outside diameter by 12 feet. long may weigh less than 100 pounds and, depending on the actual materials used, may even weigh less than 50 pounds. The cylindrical shell of the artificial sport log of the invention is preferably formed using a rotational molding technique.

An alternate embodiment of the log of the invention along with auxiliary training devices that can be used with any embodiment of the logs to modify log rotation are shown in FIGS. 8-13B.

Figure 8:
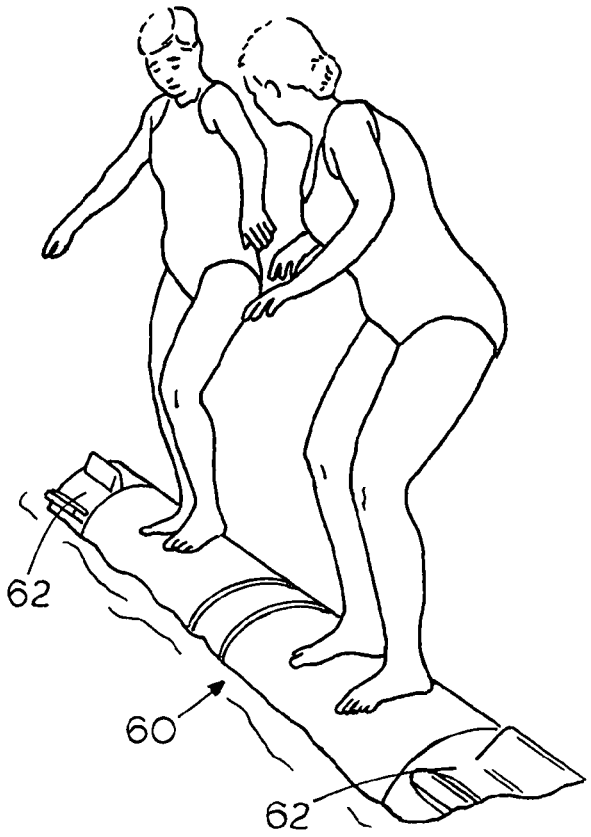
FIG. 8 is a perspective view of a log embodiment incorporating a pair of spaced paddle wheel training devices in use.
Figure 9:
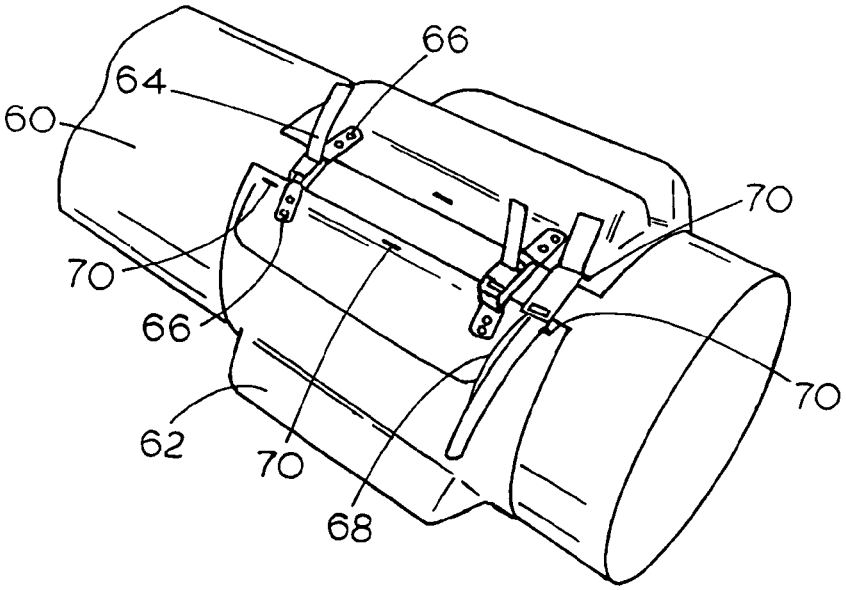
FIG. 9 is an enlarged fragmentary perspective view of a log with the end cap removed illustrating attachment methods for the training devices of the invention.

FIG. 8 shows a log 60 in use floating in water with a pair of removable auxiliary training devices in the form of strapped-on paddle wheels or "training Wheels" 62 attached in spaced relation toward the ends of the log. FIG. 9 shows one of the training devices of FIG. 8 enlarged and illustrates two methods of securing the training device to the log. One method includes a plurality of spaced straps 64 in an arrangement that are attached by rivets or the like 56 to the end sections of the training device 62. A preferred embodiment includes a plurality of removable straps, one of which is shown at 68 and in FIG. 10D, which are threaded through spaced slots 70 in the ends of the auxiliary training device. The slots are better shown in FIGS. 10A and 10B. Preferably, three slots are used, but the number can vary.

Figure 10A:
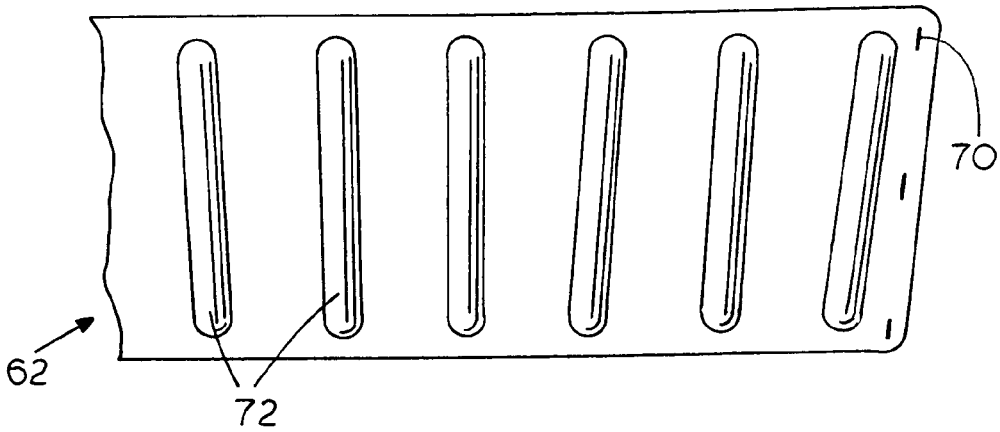
FIGS. 10A-10C are fragmentary top, bottom and profile parts of several embodiments of views of paddle wheel training devices in accordance with the invention.
Figure 10B:
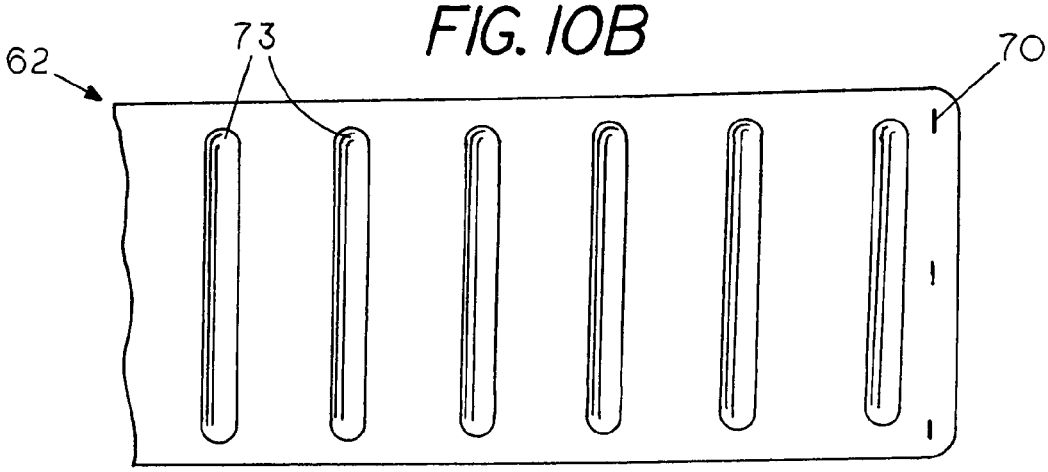
Figure 10C:
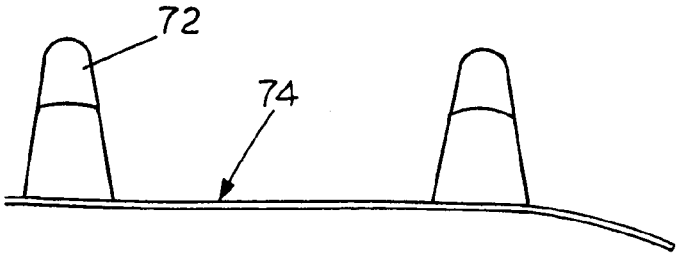

FIGS. 10A-10C show fragmentary top, bottom and side views of several embodiments of successful training devices as at 62A and 62B, which include a plurality of spaced raised projected paddles 72 on one side, which may be designated the upper or top side, with corresponding recesses 73 on the lower or bottom side along the material 74. A typical training device may be about 45 inches (114 cm) long by 18 inches (45.7 cm) wide with seven spaced paddles which are about 16 inches (40.6 cm) long and about 2.5 inches (6.4 cm) in height. This will fit a 16-inch (40.6 cm) diameter log quite well. Other lengths and widths can be used for different sized logs or for more or less effect on log rotation, as the auxiliary training devices can be made any size with the number and height of paddle projection varying also In addition, paddle projections may, as at 72A in FIG. 10F, be provided with additional material including brush-like arrangements 75 shown incorporated in the projections 72A in FIG. 10F to smooth the interaction with the water and reduce any splashing effect as the log and the training device rotate in use. The brush-like projections may extend ½ inch (1.27 cm) or more above the paddles.

Figure 10D:
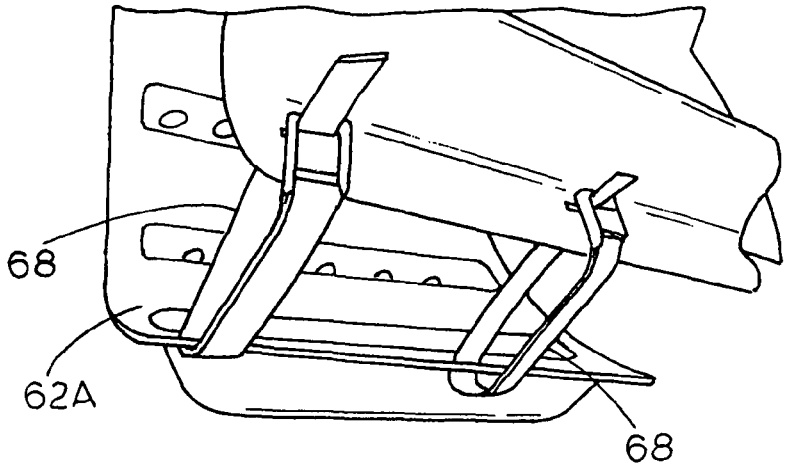
FIGS. 10D and 10E are fragmentary perspective views showing auxiliary training devices including a series of openings in the raised paddles.
Figure 10E:
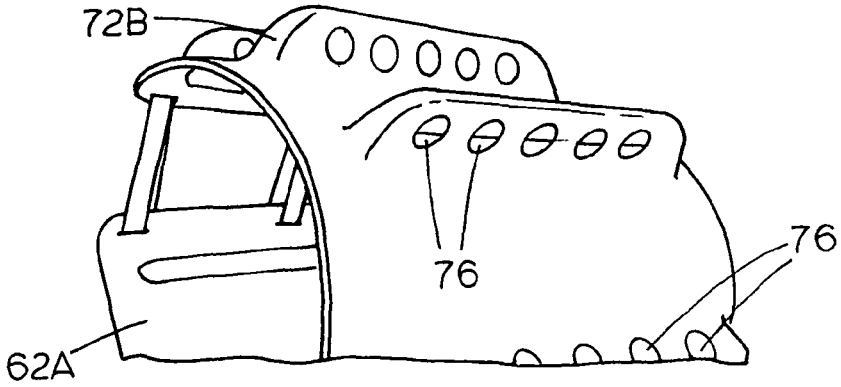
Figure 10F:
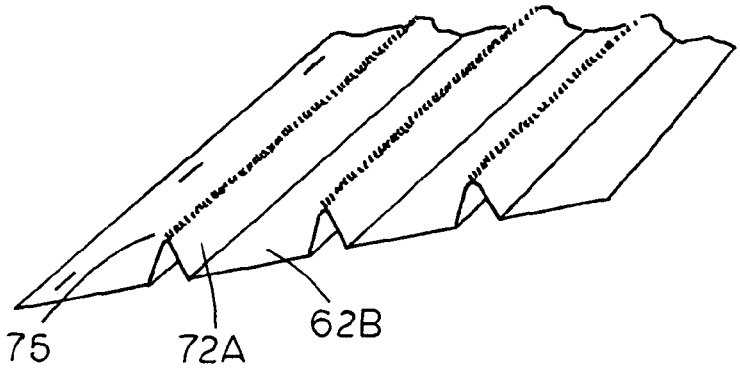
FIG. 10F is a further fragmentary perspective schematic view depicting an auxiliary training device incorporating brush structures on the raised paddles.

Another modification is shown in FIGS. 10D and 10E in which some or all of the projections 72B are provided with a plurality of spaced openings or holes which have been found to interact with the water to make the paddles even more effective.

The required amount of rotation control necessary can vary greatly with the skill of the users. Generally, depending on the skill level of the participant, one to three auxiliary training devices are commonly used.

It has been found that devices of about the size of the embodiment described above work very well and two such devices placed near the ends of a 16" (40.6 cm)×12 foot (366 cm) log can provide excellent rotation control.

Thus, the auxiliary training devices, in effect, form strap-on paddle wheels that impede the rotation of the logs in water and any desired number or size may be attached to a log so long as end-to-end symmetry is maintained so that rotation characteristics are uniform along the log. In FIG. 8, two devices are depicted near opposite ends of the log to keep rotation in balance. Slowing the rotation of the log makes it easier for persons learning log rolling to keep their balance on a rotating log and to acquire the skills necessary to compete on unimpeded logs. It also makes the sport more entertaining for those participating on a limited basis for amusement. Thus, the training devices act in manner comparable to training wheels for bicycles.

One preferred material for the training devices is high density polyethylene. As indicated, the paddles may be modified to incorporate a brush or brush-like structure.

It should also be noted that, while the auxiliary training devices of the invention have been developed for use with the artificial sport logs of the invention, it is also contemplated that the devices may be applied to natural logs as well, as they will also provide similar beneficial rotation control aspects to natural logs.

Figure 11:
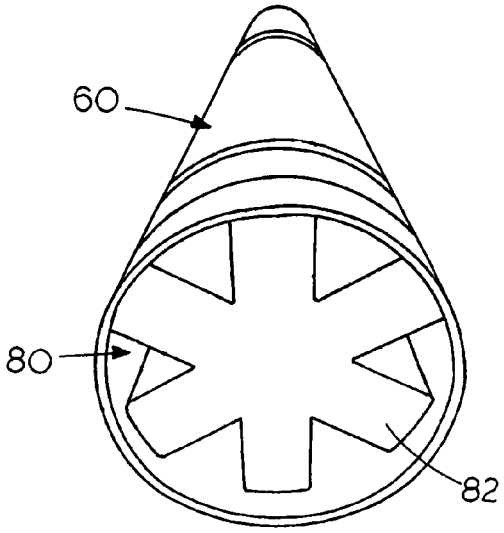
FIG. 11 is a perspective view that depicts an alternate interior log baffle to that shown in FIG. 2.

FIG. 11 depicts log 60 with an end cap removed and showing an internal baffle 80 with six projecting arms 82. This embodiment may have a shell manufactured from high density polyethylene, possibly recycled, and an internal baffle made from high density polystyrene foam. The combination of these materials and the use of six projections enables the shell to be quite thin, possibly having a thickness of only 0.25 inch (0.64 cm) or less. The baffle projections are provided with spaced slits or openings to facilitate filling and draining of the log in all compartments. It is also contemplated that a shell could be fabricated from lightweight metal, such as aluminum or other suitable material.

Figure 12A:
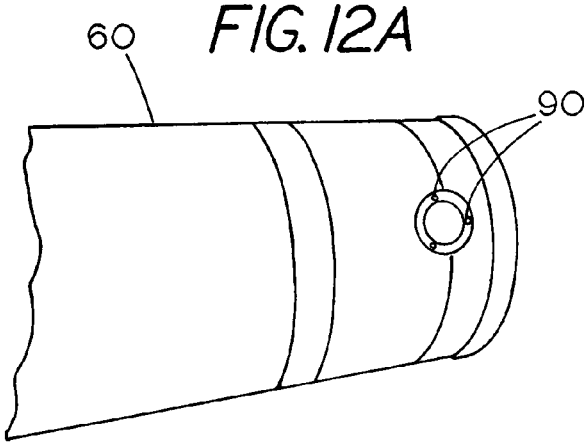
FIGS. 12A-12C depict a capped fill port, fill port opening, and fill port cap assembly for a log in accordance with the invention.
Figure 12B:
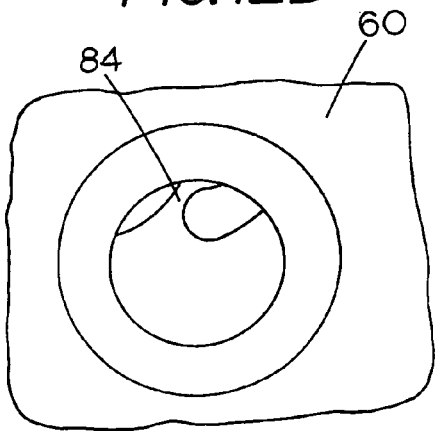
Figure 12C:
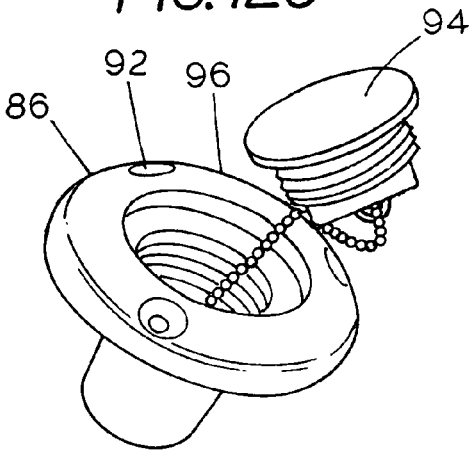

FIGS. 12A-12C depict a fill/drain cap system for the log 60 in which the fill/drain cap is located in the sidewall of the log rather than the end cap. The system is mounted in a fill port opening as at 84 in FIG. 12B and includes an insert member 86 with extended neck 88 that mounts in fill port 84 where it is secured as by threaded fasteners 90 through countersunk openings 92. Adhesive can also be used to provide a water-tight seal around the insert. A threaded cap 94 is tethered to the insert at 96.

Figure 13A:
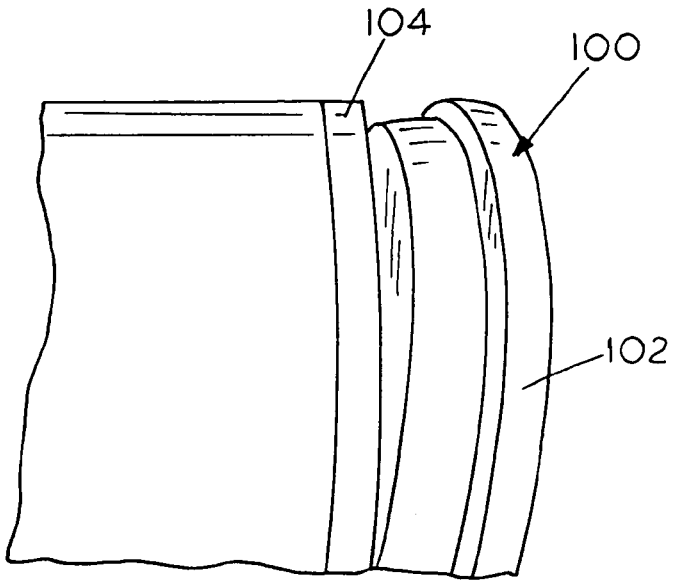
FIGS. 13A and 13B depict a log end with a solid end cap.
Figure 13B:
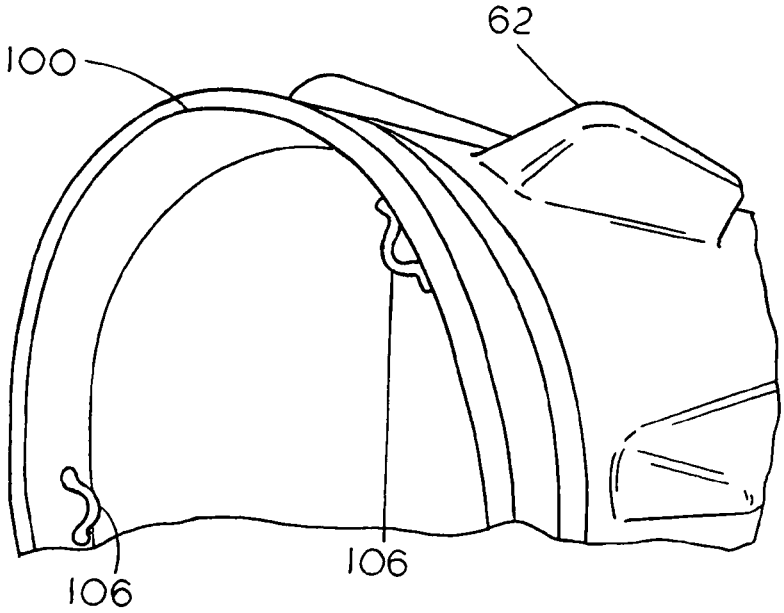

As shown in FIGS. 13A and 13B, in this embodiment, end caps 100 are made without openings and are preferably permanently attached to the ends of the log. Thus, the end caps are molded with an outer ring 102 which fits over a prepared log end section 104 and is permanently attached by an epoxy or other suitable adhesive. Tether handles are shown at 106.

The areas of the surface of the log to be used by the log rollers may be roughened to provide a built-in traction surface that is barefoot-friendly and also usable with aquatic shoes having gripping soles. Such a surface is shown in FIG. 8.

Figure 14:
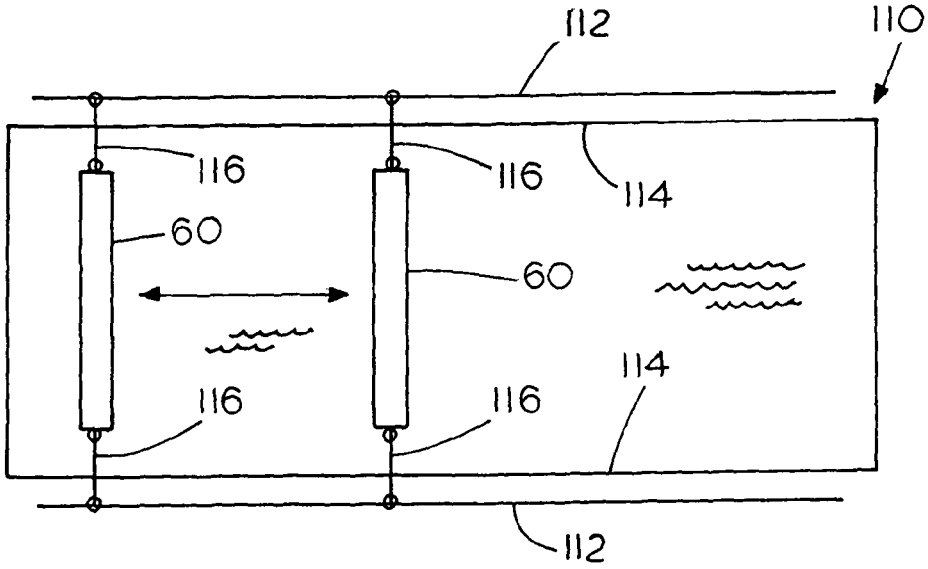
FIG. 14 depicts a tether system for use with a log in accordance with the invention in a pool.
Figure 15:
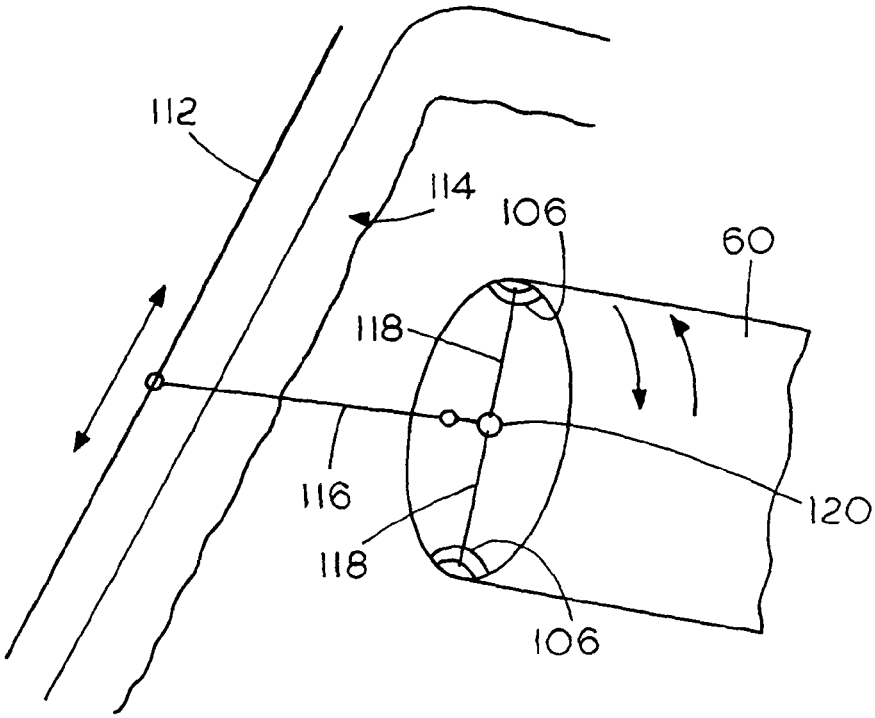
FIG. 15 shows a possible tether connection for the log.
Figure 16A:
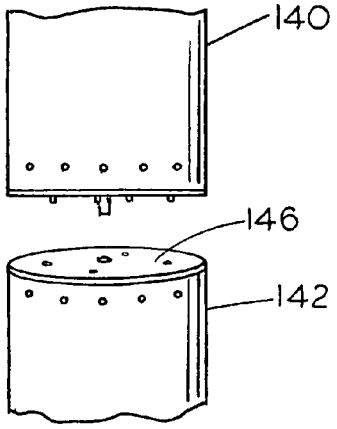
FIGS. 16A-16D depict fragmentary views of a two-section log arrangement showing a method of joining the sections.
Figure 16D:
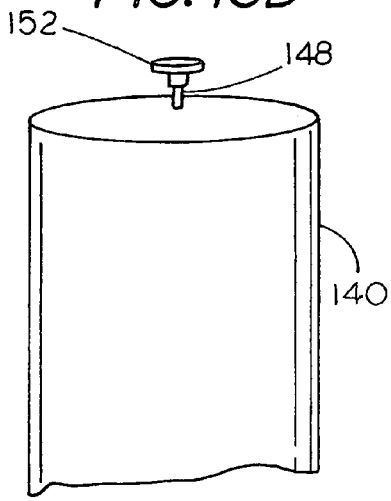
Figure 16B:
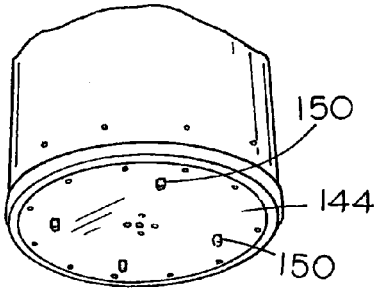

FIGS. 14 and 15 illustrate a system for maintaining alignment of a log for use in a swimming pool. In FIG. 14, a log 60 is shown at two locations in a pool 110. The log is tethered between a pair of spaced guide cables 112 mounted and extending along and parallel to the sides of the pool 114. The log is connected between guide cables 112 by control wires 116 which are mounted to move along the guide cables 112 while maintaining the disposition of the log parallel to the ends of the pool. As shown in FIG. 15, the handles 106 may be connected by wires to a common turnbuckle 120, or the like, to enable free rotation or spinning of the tethered log 60 at any position along the guide cables 112.

Figure 16C:
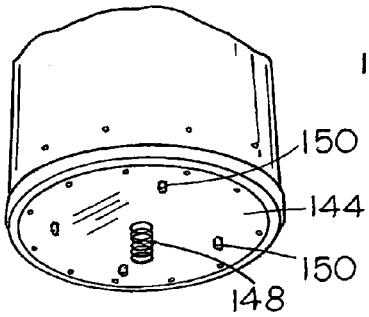

FIGS. 16A-16D are fragmentary views that show another example embodiment of an artificial sport log in accordance with the invention made by assembling a plurality of log sections. Thus, log sections 140 and 142 are provided with facing opposed end plate members 144 and 146. The sections are joined using a heavy threaded member 148 and a plurality of projecting shaped stabilizing members 150 spaced about the end plate member 144. As seen in the figures, heavy threaded member 148 may extend the length of section 140, protruding as shown in FIG. 16C. A handle device 152 for turning the threaded member is shown in FIG. 160. The threaded member is tightened to pull the sections 140 and 142 together and relative rotation is prevented by the stabilizing members 150 which fit into corresponding openings or recesses in plate member 146.

Figure 17:
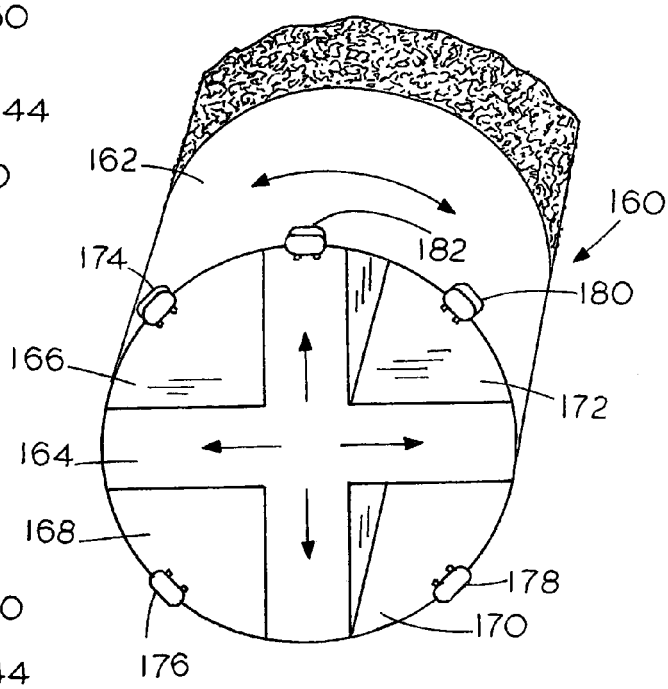
FIG. 17 is a fragmentary perspective schematic drawing showing another embodiment of the artificial log of the invention with end cap removed to reveal interior construction.

FIG. 17 depicts a fragmentary, perspective schematic view of another embodiment of the artificial sport log of the invention in which the shell of the log is made of an inflatable stable material such as a multi-ply polyvinylchloride (PVC) reinforced fabric, that is preferably 500 denier drop stitch material or equivalent that is readily available in commerce. The partial log is shown at 160 and includes an outer shell 162. The end cap is shown removed to reveal an interior construction. An internal baffle is shown at 164, which is in the form of an inflatable hollow design in the shape of a cross. The baffle 164 is fixed to the interior of the shell 162 and extends the length of the shell. The illustrated baffle 164 has four extending elements that divide the interior of the log into four distinct water chambers 166, 168, 170 and 172, which are provided with fill ports and caps, which may be similar to those shown for other embodiments at 174, 176, 178 and 180, respectively. Baffles with other numbers of segments such as 6 or 8, of course, may also be used. An air inlet/exhaust port is shown connected to the baffle air chamber at 182.

This embodiment can be collapsed and folded for transport and inflated for use. The baffle air chamber can be inflated to 20-25 psig or more internal pressure which, in turn, stretches the fabric of the outer shell to form a tight stable round surface. The chambers outside the baffle can then be filled with fluid, preferably water, to prepare the log for use. As with other embodiments of the artificial sport log, the inflatable model can be tailored to mimic any natural log of interest in size and weight. The training devices of the invention can be attached to an inflatable log as well This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself,

What is claimed is

1. An artificial sport log having physical properties that optimally mimic a log of interest comprising:

(a) a hollow cylindrical shell of a suitable material having an external and an internal surface and defining a volume and having desired dimensions of length and diameter of a log of interest;

(b) an internal baffle of a polymeric material in the form of a lightweight rigid polymeric shape that divides the internal volume into a plurality of compartments, said baffle being fixed to said internal surface of said cylindrical shell and containing openings allowing communication between said compartments;

(c) end closure members at ends of said hollow cylindrical shell, and (d) one or more fill/drain ports in said cylindrical shell for adding and draining water from said artificial log, said fill/discharge ports being further provided with removable closure caps.

2. An artificial sport log as in claim 1 wherein said log of interest is a selected natural log and wherein the relative volume of the internal baffle is determined such that the buoyancy of said artificial log generally equals the buoyancy of said selected natural log of interest when the artificial log is filled with water.

3. An artificial sport log as in claim 2 wherein the internal baffle is shaped such that the mass moment of inertia resembles that of said selected natural log of interest.

4. An artificial sport log as in claim 3 wherein said internal baffle has a cross section in a shape having 6 projections and divides the internal volume of the hollow cylindrical shell into six compartments extending the length of said log.

5. An artificial sport log as in claim 1 wherein said hollow cylindrical shell is fabricated from a material comprising high density polyethylene and said internal baffle is fabricated from a material comprising polystyrene foam.

6. An artificial sport log as in claim 1 wherein each said one or more fill/drain ports includes a tethered fill cap.

7. An artificial sport log as in claim 1 further comprising one or more attachable auxiliary training devices containing a plurality of raised paddles that impede the rotation of said log in water.

8. An artificial sport log as in claim 7 including a plurality of auxiliary training devices.

9. An artificial sport log as in claim 7 wherein said one or more training devices include a plurality of openings in said raised paddles.

10. An artificial sport log as in claim 7 wherein said raised paddles include brushes.

11. An artificial sport log as in claim 1 wherein areas of the surface of the log are of a rough texture to provide traction for users.

12. An artificial sport log as in claim 1 containing a plurality of sections fastened together.

13. An artificial sport log as in claim 1 further comprising a tether system for controlling the alignment of said log in a pool while allowing free spinning of the log.

14. An auxiliary training device for attachment to a log for use in controlling rotation or spinning of the log in water comprising a length of polymeric material having series of spaced raised paddle projections extending transverse of the length thereof, said training device being adapted to receive one or more associated strap devices configured to connect ends of said length of polymeric material together as it is wrapped around a logrolling log.

15. An auxiliary training device as in claim 14 further comprising a plurality of slots toward the ends of said length of polymeric material adapted to receive said strap devices.

16. An auxiliary training device as in claim 14 wherein said device is made of high density polyethylene.

17. An auxiliary training device as in claim 14 wherein said raised paddle projections are provided with a Plurality of spaced openings.

18. An auxiliary training device as in claim 14 wherein said raised paddle projections further comprise brushes.

19. An artificial sport log having physical properties that optimally mimic a log of interest comprising:

(a) a collapsible continuous hollow cylindrical shell of a suitable fabric material having an external and an internal surface and defining a volume and having desired dimensions of length and diameter of a log of interest;

(b) an internal baffle of an inflatable material in the form of a lightweight hollow polymeric shape having a plurality of elements that divide the internal volume into a plurality of compartments, the elements being fixed to the internal surface of said hollow cylindrical shell;

(c) a fill/exhaust port connected to said internal baffle to inflate the baffle with air; and (d) one or more fill/drain ports in said cylindrical shell for adding and draining water from said artificial log, said fill/discharge ports being further provided with removable closure caps.

20. An artificial sport log as in claim 19 wherein said baffle divides the internal volume into four chambers.

* * * * *